United States Patent [19]

Favier

[11] 3,942,587

[45] Mar. 9, 1976

[54] HEAT CONVECTOR FOR USE IN BUILDINGS

[75] Inventor: Michel Favier, Bezange-la-Petite, France

[73] Assignee: Swiss Aluminium Ltd., Chippis, Switzerland

[22] Filed: Aug. 26, 1974

[21] Appl. No.: 500,589

Related U.S. Application Data

[63] Continuation of Ser. No. 342,449, March 19, 1973, abandoned.

[30] Foreign Application Priority Data

Mar. 23, 1972 France ..... 72.10136
Mar. 13, 1972 France ..... 72.8834

[52] U.S. Cl. ..... 165/129
[51] Int. Cl.[2] ..... F24H 9/08
[58] Field of Search ..... 165/128, 131, 130, 55, 165/170, 153; 285/370

[56] References Cited

UNITED STATES PATENTS

| | | | |
|---|---|---|---|
| 1,907,527 | 5/1933 | Erskine | 165/55 |
| 1,915,226 | 6/1933 | Hanacher | 165/129 |
| 1,958,899 | 5/1934 | Mac Adams | 165/170 X |
| 2,930,591 | 3/1960 | Persson | 165/129 |
| 3,541,785 | 11/1970 | Wahnschaffe et al. | 285/370 |

FOREIGN PATENTS OR APPLICATIONS

| | | | |
|---|---|---|---|
| 729,554 | 5/1955 | United Kingdom | 165/129 |
| 1,222,194 | 2/1971 | United Kingdom | 165/130 |

*Primary Examiner*—Wendell E. Burns
*Assistant Examiner*—Theophil W. Streule, Jr.
*Attorney, Agent, or Firm*—Ernest F. Marmorek

[57] ABSTRACT

This invention relates to a convector heater for use in buildings, constituted of columns, wherein each column constituted by a section comprises a pipe in which a fluid circulates and which is integral with heat exchange ribs, said heating columns being connected at their ends by means of a separate collector acting as fluid distributor and means of assembly between several columns.

7 Claims, 6 Drawing Figures

122
104a
114
113a
113
121
115
112a
112
110
124
107
125
105
105a
115
116
106
101
117
118
104
119a
103
120a
102
120
119
123

HEAT CONVECTOR FOR USE IN BUILDINGS

This is a continuation of application Ser. No. 342,449, filed Mar. 19, 1973, now abandoned.

The present invention relates to a heat convector for use in buildings.

It has been known for a long time that cast-iron radiators may be used for heating buildings, but they have numerous disadvantages, due to their bulk, considerable weight, coupling of the elements by internal connecting members, difficulties in sealing, large quantity of liquid used for heat exchange and lack of aesthetics. Consequently, these radiators are difficult to instal in a building and to supply with heating fluid.

It is also known to use radiators made of steel, convectors, fixed radiating panels which form part of a range of apparatus, the use of which is more or less adapted to the different types of use, since they present a well defined shape and dimensions. Furthermore, these apparatus, when they are installed, do not enable one or more elements to be removed or added should it be desired to put right an error made in technical research.

It should also be added that these heating apparatus proportionally give out only a small amount of heat.

The convector for heating buildings according to the invention enables these drawbacks to be overcome.

In accordance with the invention, a convector is used which is constituted of heating columns, each of which is constitued by a section comprising a pipe in which a fluid circulates and which is integral with heat exchange ribs, said heating columns being connected at their ends of means of a separate collector acting as fluid distributor and means of assembly between several columns.

The heating columns which may be made of aluminium may have a very reduced weight and may be mounted or dismantled very easily and rapidly, thus enabling the heat exchange surface of the convector to be varied in one sense or the other, as required.

Furthermore, the heating columns constituting a convector may be stored separately before the heating installation is assembled.

The convector according to the invention has a very high calorific power and yield for a very low output from the heat source.

According to another characteristic, the heating apparatus which is obtained is very aesthetic and its overall dimensions are very reduced in proportion to its calorific power.

By its constitution, the convector according to the invention may receive electrical resistances in addition to any heating fluid, and the apparatus may be used in an integrated electrical heating installation.

According to another characteristic of the invention, on the flat wall of the section there are provided means of fixing a removable cover surrounding the radiating ribs and the pipe.

This latter arrangement enables convectors to be produced which are particularly aesthetic in shape, since the heating columns and their fins are hidden behind covers which may present whatever shape and colour the consumer deisres. In Addition, it is possible to blacken the heating section in order to increase the emissive power thereof, without impairing the aesthetics, since this section is hidden behind the cover.

Furthermore, since the covers are removable, it is particularly simple to replace them without touching the heating members, and thus to modify the outside appearance of the heating apparatus to make it harmonise with the decoration of the room in which it is placed.

The invention will be more readily understood on reading the following description, reference being made to the acompanying drawings, in which.

Figure 1:
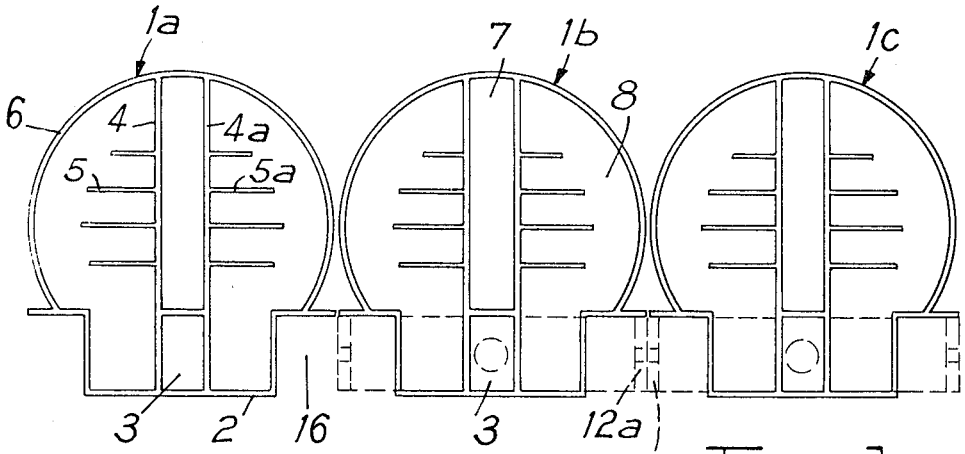
FIG. 1 is a plan view of the heating columns constituting the convector.

Referring now to the drawings, FIG. 1 shows three heating columns 1*a*, 1*b*, 1*c* which form a convector according to the invention and which are constituted by sections, particularly made of aluminium, having a rear wall 2 against which is adapted a rectangular pipe 3 in which the heating fluid circulates, said pipe 3 being extended in front by two partitions 4, 4*a* bearing fins 5, 5*a* respectively, around which is arranged a cover 6 integral with the rear wall 2 and the partitions 4, 4*a* so as to arrange vertical pipes 7 and 8 in which the air circulates around the fins 5, 5*a*.

Figure 2:
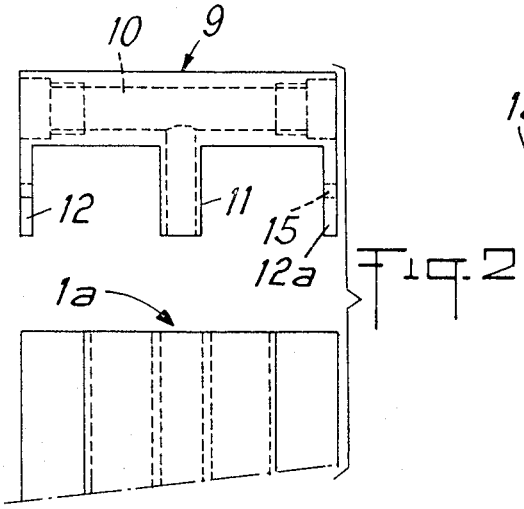
FIG. 2 is a front view of a heating column and a collector element being mounted.
Figure 3:
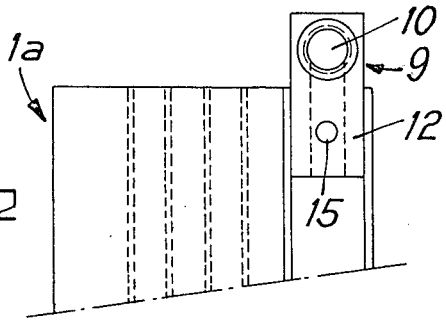
FIG. 3 is a side view of a heating column on which a collector element is mounted.
Figure 4:
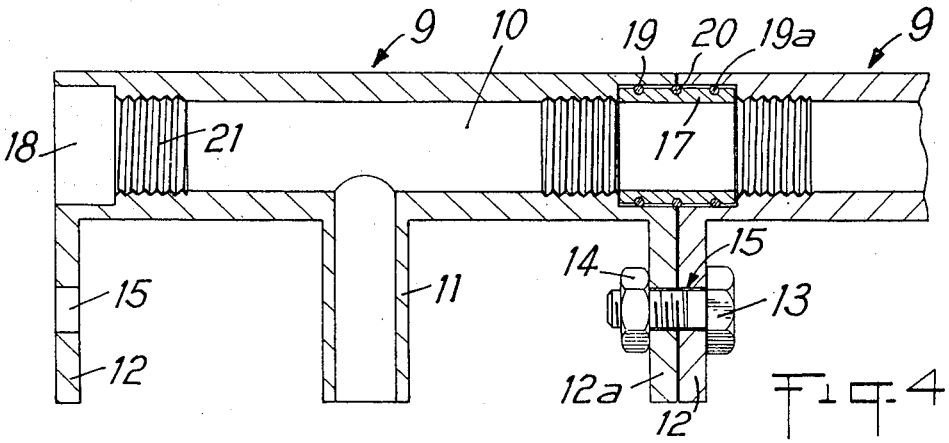
FIG. 4 is a section showing the assembling of two collector elements.

At the two ends of the heating columns 1*a*, 1*b*, 1*c* are mounted two collectors intended for the circulation of the heating fluid, only one of which the upper collector has been shown in FIGS. 2, 3 and 4, the lower collector being identical.

Each collector is constituted of E-shaped elements 9 fixed to the top or bottom respectively of the rear wall 2 of each section of the heating column 1*a*, 1*b*, 1*c*.

Fixing is effected in particular by cold gluing or polymerisation.

Each collector element 9 has a body in which is provided a pipe 10 for the circulation of the heating fluid, which is connected to the pipe 3 through pipe 11 with external rectangular section fitted in said pipe 3.

At its ends, each collector element 9 has lugs 12, 12*a* which are connected to the lugs 12, 12*a* of the adjacent elements 9 by a fixing means such as a screw 13 engaged in a hole 15 made in the lugs 12, 12*a* and on which a nut 14 is screwed.

To allow the lugs 12, 12*a* to be fitted between the heating columns, the rear wall 2 is shaped to present a housing 16 in which said lugs are engaged (FIG. 1).

The junction between the collector elements 9 is ensured by means of sleeves 17 which are engaged in recessings 18 provided at the ends of the elements 9, said sleeves are provided with lateral and central sealing gaskets 19, 19*a* and 20. The central gasket 20 is disposed at the level of the joint between the two elements.

Furthermore, the collector elements 9 are provided with threaded holes 21 for their connection to the heating pipes of the installation. These elements may for example be taken from a E-section of adequate dimensions, this enabling a pipe with external rectangular section to be directly obtained, together with the side lugs.

Figure 5:
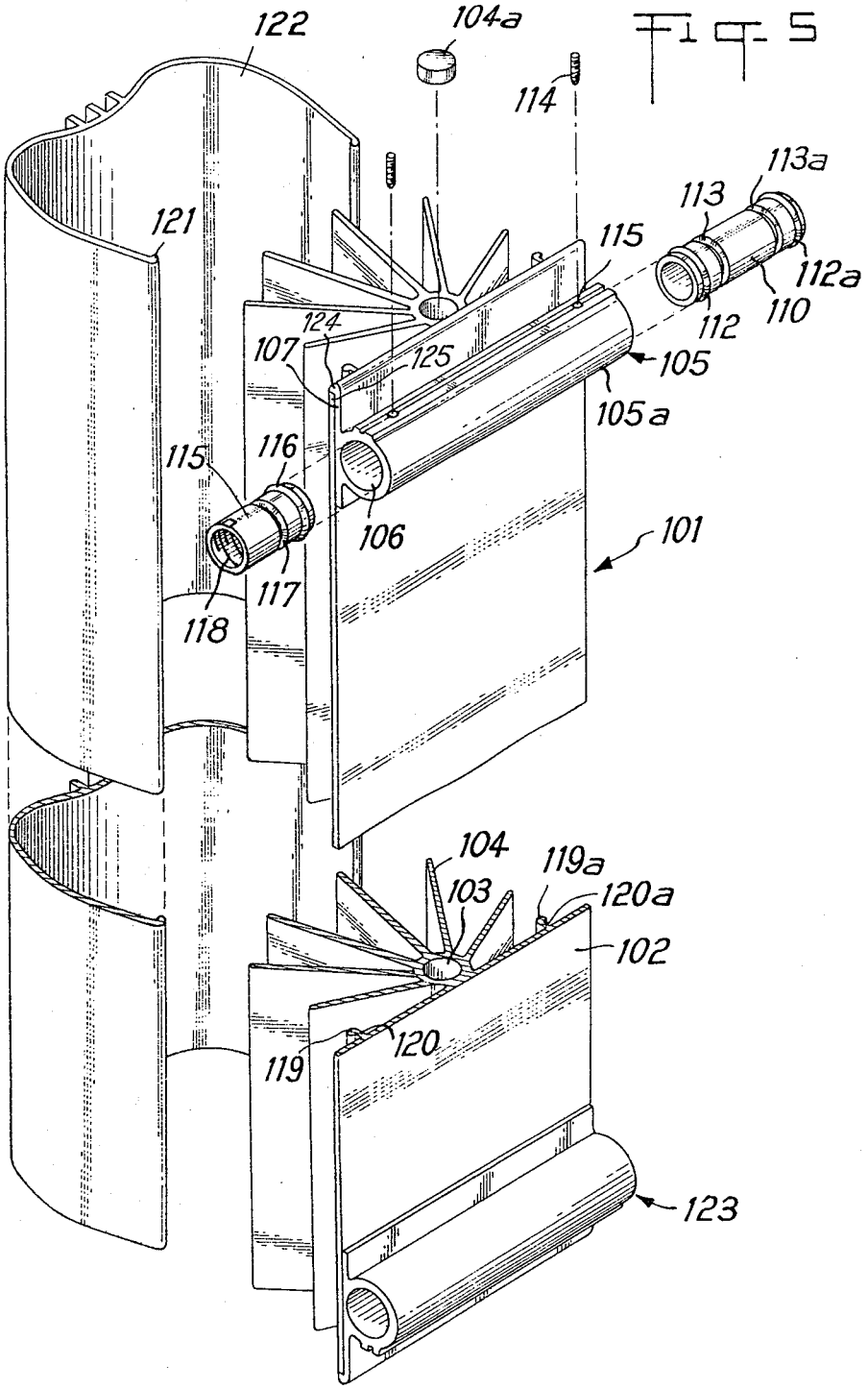
FIG. 5 is an exploded view of a heating column according to the invention.
Figure 6:
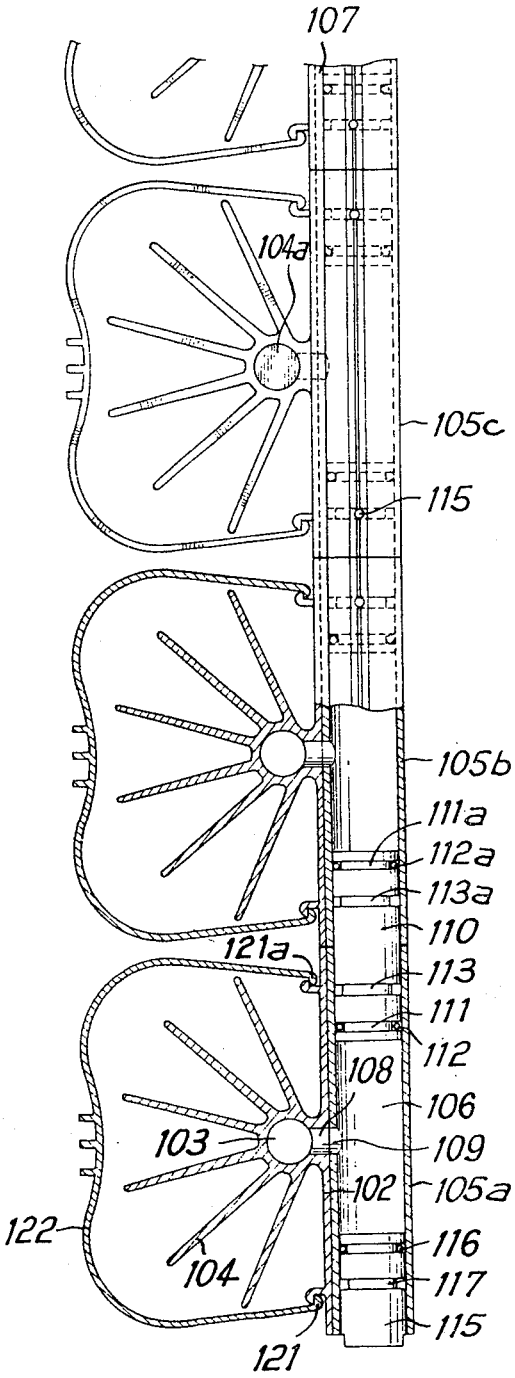
FIG. 6 is a top view in partial section of an assembly of heating columns constituting a convector.

FIG. 5 shows one of the heating columns which constitutes the convector according to the invention, shown in plan view in FIG. 6.

Each heating column comprises a section 101 made in particular of aluminium which presents a flat wall 102 against which is adapted a pipe 103 for fluid extending over the whole height of the section and closed at its two ends by stoppers 104a fixed by any known means in the pipe 103.

Convergent fins 104 are disposed around the pipe 103 on the same side of the flat wall 102, the whole of the flat wall 102 of the pipe 103 and the fins 104 constituting one and the same section 101.

At the upper and lower parts of the section 101 are mounted upper and lower collectors 105 and 123 respectively, which ensure the circulation of the fluid. Each collector is constituted of elements 105*a*, 105*b*, 105*c* which each comprise a pipe 106 and a flat part 107 which is fixed, particularly by gluing, to the rear face of the flat wall 102 of the section 101.

For the communication between the pipes 103 and the internal pipe 106 of the collector elements 105*a*, 105*b*, 105*c*, there is provided in the flat wall 102 of the section 101 an opening 108 which opens through a corresponding aperture 109 into the pipe 106 of the element 105*a*, 105*b*, 105*c*. Each collector element 105*a*, 105*b*, 105*c* advantageously comprises on one of the edges of the flat part 107 a rib 123 abutting on an edge 125 of the flat wall 102 of the section, apertures 108 and 109 being previously made at adequate spots in the wall 102 of the section 101 and the part 107 of the collector element 105, respectively, this arrangement of the rib 124, which ensures marking, makes it possible easily and accurately to assemble the collector element on the section and guarantees the exact positioning of the opening 109 opposite opening 108 as well as the alignment of the pipes 106 in anticipation of the later assembling of the columns to form a convector.

The elements 105*a*, 105*b*, 105*c* are connected together by sleeves 110 which have grooves 111, 111*a* in which are disposed sealing gaskets 112, 112*a* and grooves 113, 133*a* in which are engaged the ends of screws 114 screwed in threaded holes 115 in the wall of the collector elements 105*a*, 105*b*, 105*c*. This arrangement makes it possible to connect both the collector elements and the sections 101 on which the elements of collectors 105 and 123 are fixed.

On the end section of the convector, the elements 105 receives (FIG. 6) a stopper 115 which is provided with a sealing gasket 116 and a groove 117 in which a screw 114 is engaged.

In the embodiment shown in FIG. 5, the stopper 115 comprises a threaded hole 118 for connecting the collector 105 to a pipe of the heating installation.

It is obvious that the outer face of the stopper 115 may also be threaded.

On the two edges of the flat wall 102 are provided ribs 119, 119*a* delimiting grooves 120, 120*a* in which the edges 121, 121*a* of covers 122 are engaged by sliding or fitting, said covers being disposed around the fins 104 of the section and pipe the air circulating around the fins to form a heating column.

Heating columns with cover incorporated therein as shown in FIG. 1 may also be combined with collectors applicable to the rear face as shown in FIGS. 5 and 6.

What I claim is:

1. A heat convector for use in a space, comprising, in combination:

a plurality of heating columns disposed adjacent each other;

a pipe disposed in each of said columns for conducting a fluid;

a plurality of heat exchange ribs integral with each pipe; and a collector near each end of said heating column and in communication with the pipe therein for the supply of the fluid;

the collectors of adjacent columns being interconnectable, whereby an integral unit of said columns is obtained and said collectors form a continuous fluid path at each end of said heat convector;

each of said collectros having a substantially flat assembly surface aligned with and adjacent the column to which it is connected.

2. The heat convector as claimed in claim 1, wherein said collectors are interconnected by cold gluing or by polymerisation.

3. The heat convector as claimed in claim 1, wherein each of said collectors comprises an E-shaped element having a centrally disposed conduit operable for engaging one of said pipes and lugs disposed at each of its ends for interconnecting said columns.

4. The heat convector as claimed in claim 1, wherein said collectors comprise sleeves and gaskets for interconnecting said columns with substantially leak proof seals.

5. The heat convector as claimed in claim 1, wherein each of said heating columns has a substantially flat rear surface extending substantially the length of the pipe therein and substantially encloses the heat exchange ribs and pipe therein except for openings defined at its two ends, whereby air can circulate through the column past the heat exchange ribs therein.

6. The heat convector as claimed in claim 1, wherein each of said heating columns include a substantially flat wall to which the pipe therein is connected and a removable cover surrounding the heat exchange ribs therein and connected to the flat wall.

7. The heat convector as claimed in claim 1, further comprising removable closure means connected to the collectors in the end heating columns, whereby additional heating columns may be added by the removal of the closure means.

* * * * *